United States Patent [19]

Thomsen et al.

[11] 4,201,711

[45] May 6, 1980

[54] METHOD OF MANUFACTURING PRESTRESSED CONSTRUCTION ELEMENTS IN A LONG MOULD BED

[75] Inventors: Ove Thomsen; Per-Erik Bondpers, both of Växjö, Sweden

[73] Assignee: A-Betong AB, Växjö, Sweden

[21] Appl. No.: 900,624

[22] Filed: Apr. 27, 1978

[30] Foreign Application Priority Data

Apr. 29, 1977 [SE] Sweden ..... 7705021

[51] Int. Cl.[2] ..... B28B 23/04

[52] U.S. Cl. ..... 264/157; 264/228; 425/111

[58] Field of Search ..... 264/228, 157; 425/111

[56] References Cited

U.S. PATENT DOCUMENTS

| | | | |
|---|---|---|---|
| 3,611,518 | 10/1971 | Glass | 425/111 X |
| 4,038,355 | 7/1977 | Bratchell | 425/111 X |
| 4,102,957 | 7/1978 | Da Re | 264/228 X |

*Primary Examiner*—Thomas P. Pavelko

*Attorney, Agent, or Firm*—Sughrue, Rothwell, Mion, Zinn and Macpeak

[57] ABSTRACT

In a method of manufacturing consecutive pre-tensioned concrete elements, e.g. concrete sleepers, in a long mould bed, reinforcement ropes are tensioned and closure members are placed between different elements. Prior to casting closure members which are so formed that two or more cast elements are joined together via bridges or shoulders projecting outwardly fron the elements and surrounding the reinforcement ropes are placed in the mould bed at predetermined intervals. The string of cast elements is advanced to an element-separating station at one end of the bed where the elements are successively cut by means of a diamond saw or the like. The bridges between the elements are formed in a manner such that the reinforcement ropes are protected and a small, preferably the smallest possible section of concrete between the elements is severed when the elements are separated from the string of elements. The cast elements may be removed from the mould bed by lowering said moulds and carrying the string of elements on movable conveying means. Alternatively the moulds may be turned after the casting operation. The string of elements is then removed from the mould bed by pressing the string of elements down therefrom or by lifting the moulds.

The invention also concerns a mould bed for casting a string of consecutive elements of the abovementioned kind, said mould bed comprising conveying means for advancing the string of elements to a severing station at one end of the bed.

7 Claims, 6 Drawing Figures

4
5
5a
5b
24
IV
V
VI

METHOD OF MANUFACTURING PRESTRESSED CONSTRUCTION ELEMENTS IN A LONG MOULD BED

The present invention relates to a method of manufacturing prestressed moulded construction elements, such as concrete sleepers, in which there is used a long mould-carrying bed having a plurality of mould locations sequentially therealong; in which reinforcement ropes or wires are passed along said bed and through said locations and then tensioned; in which partition members are placed between adjacent mould locations to form a series of sequentially arranged moulds; and in which a mouldable substance, such as concrete, is poured into said moulds to form said elements, said elements being joined together in a string by, inter alia, said reinforcement ropes.

An object of the invention is to highly automatize the manufacture of large series of construction elements whilst carefully observing both those tolerances which the elements are required to have in respect of their use and those tolerances which must be observed in order to enable the automatized manufacturing sequence to be carried out.

A further object is to simplify the separation of one element in said string of elements from another.

Another object is to provide a method in which the reinforcement ropes used to prestress the formed elements e.g. concrete sleepers do not project from the ends of respective separated elements in a manner to cause difficulty when handling the finished elements and transporting them to the site on which they are to be used.

In its widest aspect the invention is mainlly characterized by the fact that the partition members arranged to define moulds on the mould bed have a form such that two or more elements moulded in respective moulds are joined together via shoulder-like bridges of said mouldable substance extending between said elements and surrounding said reinforcing wires; that the string of elements thus formed is severed at one end of the bed at a severing station and that the following elements in the string of elements are successively advanced, whilst carried on conveying means arranged for movement along the bed, to the severing station and there severed.

In practice it is preferred that the bridges between the elements are formed by the partition members in a manner such as to protect the reinforcing wires and such that the concrete section which need be cut to separate adjacent elements is as small as possible.

A method of manufacture according to the invention enables the manufacturing sequences to be highly automatized, primarily because a plurality of mould beds can be located adjacent one another and can be served by one and the same element-separating means. When one mould bed is prepared for casting, the casting sequence with the subsequent separation of the elements can be effected in a further bed. Because the element-separating means need only cut through a relatively small concrete section, the step of separating the elements can be effected in a simpler and cheaper manner than was before possible. The fact that a plurality of elements are joined together to form a string, via the aforesaid bridges and the through-passing reinforcing ropes, and that they move together towards the element-separating device located at one end of the bed, constitutes careful guiding of the string of elements which is a necessity in order for the automatized sequence of manufacturing steps to be carried out effectively.

When the moulded concrete elements are concrete sleepers, the thickness of the sleeper should be such that when in position between the rails it is at most only 4 mm higher than said rails. The centres of the cast shoulders should lie at most 1.5 mm from the centre line of respective sleepers. All element surfaces, with the exception of the undersurface shall be moulded and hardened against mould surfaces. Further, the undersurface of the sleeper shall be well vibrated to provide a crude surface. The lower edges of the sleeper must not be unduly damaged and the end surfaces of the sleeper shall be smoothed. The attachment fittings cast into the sleeper during the moulding thereof shall be free from concrete residues and shall be well fixed to the sleeper during the moulding process.

The compression strength of the concrete when destressed, determined on sample cubes, shall be at least 30 MPa, corresponding to about 300 kp/cm$^2$. Destressing shall be carried out slowly.

When curing the moulded sleepers, the temperature during the first two hours shall be at most 30° C. The increase in temperature must then be at most 15° C. per hour to a maximum of 60 ° C., whereafter cooling may be effected at at most 15° per hour. In the case of low outside temperatures, warm sleepers must be protected against shock when transported to external storage sites.

All of these manufacturing requirements can be fulfilled when manufacturing in accordance with the invention, whilst maintaining a high production rate.

In one method according to the invention the elements are removed from the moulds by lowering the same, whereupon the elements are carried by the movable conveying means.

Alternatively the mould bed can be turned subsequent to moulding the elements, whereafter the elements are removed from the moulds by pressing the elements down and lifting the mould.

To speed up the production rate, it may be convenient to separate elements from the string in groups of a given number, and to divide these groups into separate elements at a later stage away from the bed. Consequently, in accordance with a further embodiment of the invention, group-defining partition or specially designed closure means are inserted into the mould bed between a given number of mould locations, the closure means being so formed that the mutually adjacent end elements of consecutive groups of elements are joined substantially only by the reinforcement ropes extending therebetween, whereby one group can be separated from the other simply by cutting said ropes. These handling units are then moved by conveying means transversely of the longitudinal axis of the bed to a store, after which the handling units are cut up to form separate elements, by cutting through the connecting bridges between the elements.

One advantage to be gained with separating the string into groups of handling units is that buffer stores can be built up prior to finally separating all the elements from the string. This will eliminate the risk of disturbances or interruptions when moulding from having any great effect on the final treatment and delivery of the finished elements.

The invention also relates to a mould bed for carrying out the aforementioned method, the main characterizing features of the mould bed being disclosed in the accompanying claims.

An exemplary embodiment of the invention will now be described with reference to the accompanying schematic drawings.

Figure 1:
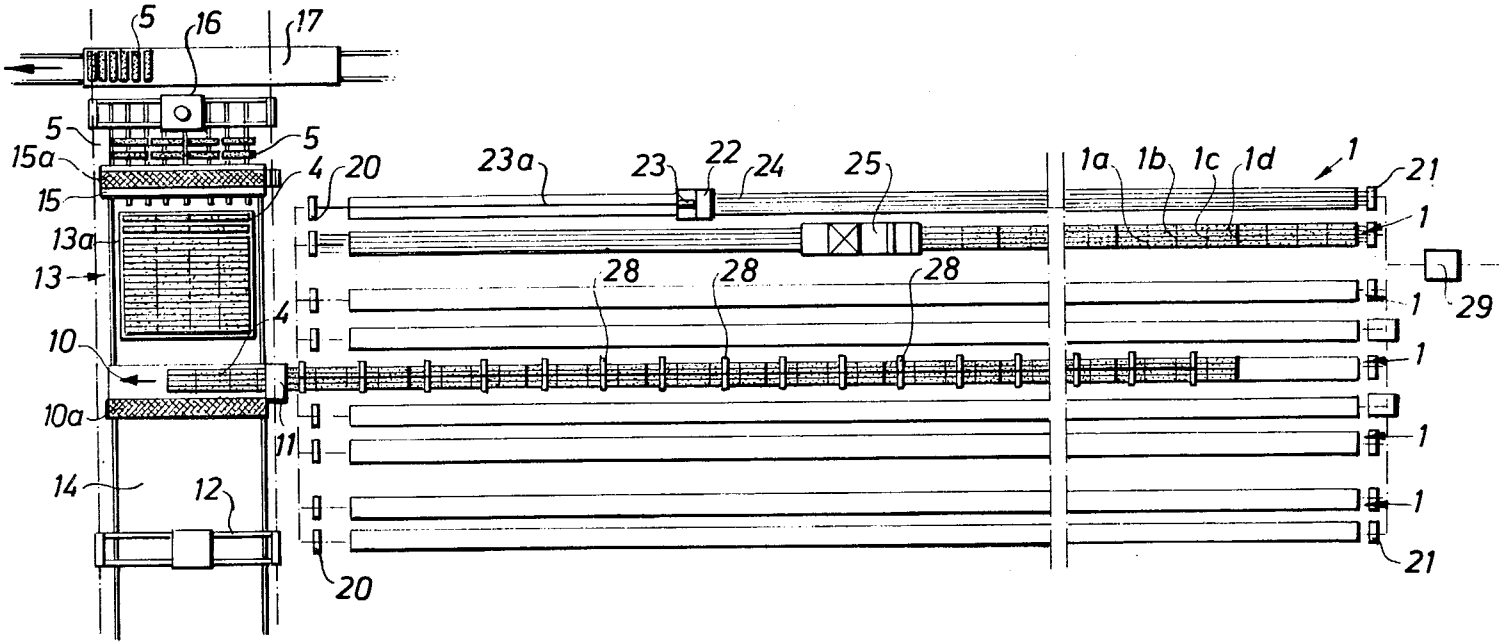
FIG. 1 is a plan view of a factory floor having a plant for the highly automatized manufacture of concrete sleepers along several mutually adjacent lines each of which comprises a mould bed having four parallel rows of moulds.

The plant illustrated in FIG. 1 comprises a plurality of mutually adjacent mould beds 1 for the manufacture of concrete sleepers. Each mould bed is relatively long, e.g. has a length of approximately 100 m or more, and has a plurality of moulds arranged sequentially thereon; these moulds being divided into groups of four, 1*a*, 1*b*, 1*c*, 1*d*, in the illustrated embodiment.

FIG. 1 illustrates reinforcement ropes or wires 24 being placed in the first bed at the top of the Figure; concrete being cast in the second bed by means of a casting machine; and shows the cast elements in the fifth bed from the top of the Figure being separated from the string of element to form handling units, each of which conveniently comprises four elements joined together, for reasons hereinafter explained.

The steps undertaken with the mould beds shown beneath the fifth mould bed include cleaning the mould locations, lubricating the surfaces thereof to facilitate removal of the elements, arranging rail-attachment elements at said locations, mounting the partition members and closure members in position and subjecting said moulds thus formed to further treatment for preparing the same for a renewed casting sequence.

To the left of the mould beds there is illustrated a mechanical apparatus for treating the formed elements. The machine elements of the apparatus comprise, inter alia, a motor-driven withdrawal carriage 10 for pulling the string of elements along the bed, element-separating means 11 and a stacking traverse 12. The withdrawal carriage 10 is arranged to move in the axial direction of the mould beds and also at right angles thereto. The traverse 12 is arranged to lift the separated handling units and move them either to a supply store 13 or a buffer or reserve store 14. The handling units are fed from the supply store to a further element-separating means 15 which separates the elements forming the handling units 4 one from the other, to form separate concrete sleepers 5. The sleeper elements are turned in conjunction herewith. A loading crane 16 loads the individual concrete elements onto a railway carriage 17, which transports the sleepers from the workshop to a storage site.

Each mould bed 1 has a passive end at which the reinforcement ropes 24 are anchored, and an active end at which the reinforcement ropes are tensioned. In the illustrated embodiment, the means by which the ropes are tensioned comprise beams 20, 21 extending transversely of the long axis of respective beds. The reinforcement ropes 24 are placed in the moulds by means of a carriage 22 which moves on rails (not shown) arranged along the upper sides of respective mould beds. The carriage 22 has self-drive means and comprises a winch 23 having a rope or line 23*a* which is anchored to the left tensioning beam 20. The carriage then moves to the right end of the mould bed, where the reinforcing ropes 24 are collected. The carriage is moved by means of the winch carrying the reinforcing ropes 24 therewith, said ropes then being tensioned between the tensioning beams 20 and 21 in a conventional manner. Upon completion of its work, the carriage 22 is moved by means of a traverse (not shown) to an adjacent mould bed, where the aforesaid sequence of operations is repeated. In this way there is provided a substantially simplified and partially automatized sequence of operations in respect of the application and tensioning of the reinforcement ropes.

Cement is poured into the next mould bed following by means of a machine 25 arranged for movement along the aforementioned rails. The machine 25 is filled with concrete from a carriage 29 movable along a system of tracks arranged in the roof of the building housing the plant, said track system extending from a mixing station, which is not shown, to the mould beds.

When preparing the mould beds for a concrete-pouring operation, there is arranged therein between a given number of moulds, in the illustrated embodiment four moulds, especially designed group-defining closure members (not shown) whose purpose is to enable groups of, say, four elements to be separated from the string of elements to form handling units 4, by simply severing the reinforcement ropes 24 by means of the element-separating device 11 on the withdrawal carriage 10.

Between the remaining, consecutive mould locations 1 in the bed there are arranged, especially designed partition members (not shown) the form of which is such that the individual concrete sleepers 5 within each handling unit 4 will be joined together through shoulder-like bridges 5*a* located at the ends thereof. These shoulders are so formed as to protect the reinforcement ropes 24 whilst exhibiting, at the same time, the smallest possible cross-sectional area.

The concrete sleepers are removed from the moulds by hydraulically forcing the moulds downwardly whilst holding the cast string of sleeper elements 5 steady. This is effected with the aid of a number of lifting carriages 28 for the sleeper elements uniformly dispersed on the rails located along the sides of the mould bed and extending above and across the bed. In the illustrated embodiment there is provided a lifting carriage 28 at each alternate sleeper element 5. Each lifting carriage 28 has downwardly directed lifting and gripping means (not shown) which are moved down between the string of cast elements and carry said elements during their transport to the left in FIG. 1 to the first element-separating station. The afore-mentioned transport is effected by means of the withdrawal carriage 10 which to this end is provided with a drive motor and gripping means which are arranged to grip the carriages 28 carrying the string of concrete elements and to drag said carriages and the elements to the left in the Figure through a distance corresponding to the length of the handling unit. Subsequent hereto the element-separating device 11, which in the illustrated embodiment comprises a diamond saw, severs the reinforcement ropes 24 between successive handling units 4, whereafter the stacking traverse moves the handling units either to the supply store 13 or to the buffer store 14. The withdrawal carriage then continues to withdraw a further handling unit 4 of four elements, so that this handling unit can be separated from the remaining string of sleeper elements.

The supply store 13 has a conveying means 13*a* arranged to move the handling units slowly to the further element-separating device 15. The elements are moved to the further element-separating device stepwise in a manner such as to separate the handling units from the string of elements at suitable distances. The element-separating device 15 cmprises a plurality of diamond saws arranged to cut through the shoulders 5*a* located between the individual sleeper elements 5 of the handling units 4 and, at the same time, to cut the ends of the handling units in a manner such that the reinforcement ropes 24 do not protrude therefrom. Subsequent to being parted, the separate elements are turned and take a position on a buffer store for loading, from where they are transported to the railway carriage 17 by means of a loading traverse 16. Both the element-separating device 15 and the withdrawal carriage 10 have a walkway 15*a* and 10*a*, respectively, along which the personnel supervising the manufacturing processes can readily walk between different sections of the plant.

Figures 2, 3, 4, 5, 6:
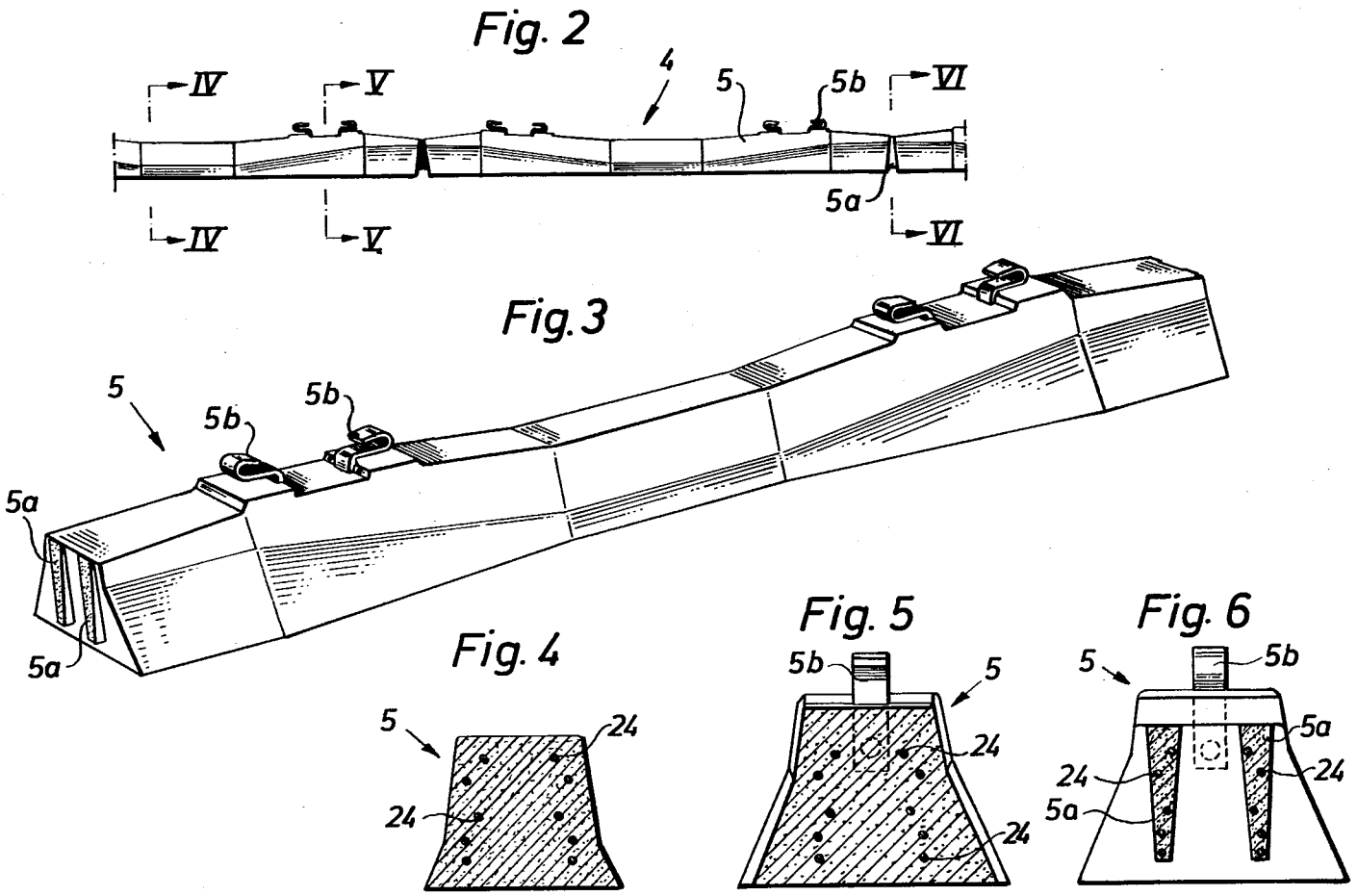
FIG. 2 is a side view of part of a manufactured handling unit comprising a number of sleeper elements joined together by said connecting bridges.
FIG. 3 is a perspective view of a finished concrete sleeper
FIGS. 4–6 are cross sectional views taken on the lines IV—IV, V—V and VI—VI of FIG. 2.

FIG. 2 illustrates part of a handling unit 4 which, during the manufacturing process, has taken an inverted position and which, in the illustrated embodiment, comprises four sleeper elements 5. Characteristic of the elements 5 are the bridges or shoulders 5*a* located at the ends thereof, these bridges surrounding the reinforcement ropes 24 but presenting the smallest possible cross section of concrete so that the smallest possible surface need be severed by the further element-separating device 15. The concrete sleepers have attachment elements 5*b* cast therein in a conventional manner.

As will be understood, the handling units 4 may comprise a number of elements which is greater or smaller than four. It is also conceivable to operate in practice without the use of handling units, in which case only one element-separating device is required which, in such a case, would be located on the withdrawal carriage 10 and would separate the elements one from another by cutting through the bridges.

The use of handling units in the manner described, however, enables the expensive machinery and mould equipment to be used to better effect by emptying the mould beds more rapidly and by building up a buffer store. It is then possible to avoid breakdowns in supply as a result of interruptions in the manufacturing operations. Thus, the finished elements need not be present in the region of the moulds for longer than is necessary, but can be removed to enable a fresh casting operation to be commenced as soon as possible.

In practice, the manufacturing process is highly automatized and consequently only one man is required for withdrawing the string of elements, severing the string to form handling units, lifting the handling units to the supply or buffer stores, removing the units from the supply store and separating the elements of said units one from the other, turning the elements and off-loading the same.

What is claimed is:

1. A method of manufacturing consecutive, pre-tensioned, concrete sleepers in a long mould bed, in which reinforcement ropes are tensioned and closure members are placed between different sleepers before the sleepers are cast, characterized by the ordered steps of: placing closure members in the mould bed at predetermined intervals prior to casting such that longitudinally successive cast sleepers are joined together by at least two spaced bridges of concrete projecting outwardly from the sleepers and surrounding the reinforcement ropes thereby forming a string of joined sleepers which may be handled as a unit while decreasing the cross-sectional area of the concrete between adjacent sleepers to be subsequently cut, removing the cast sleepers from the mould bed in a longitudinal string of joined sleepers; longitudinally advancing the string of sleepers to a separating station at one end of the bed on conveying means movable along the bed axis, and cutting the string at the bridges to separate the string into individual sleepers.

2. A method according to claim 1, further comprising: inverting the separate sleepers after the cutting through operation.

3. A method according to claim 1, wherein the string of sleepers is first cut into elongated handling units each comprising a plurality of sleepers joined end-to-end, and is thereafter advanced on a withdrawal carriage which is transversely movable at one end of the bed to a further station at which each handling unit is cut into individual sleepers.

4. A method according to claim 1, wherein the bridges between the sleepers have the smallest possible cross-section and permit the handling of the joined sleepers after the removal of a string from the mould bed without special support means.

5. A method according to claim 4, wherein the cast sleepers are removed from the mould bed by forcing the mould bed downwardly while holding the string of sleepers steady.

6. A method according to claim 1, wherein the string of sleepers, subsequent to being removed from the mould, is transported by lifting carriages movable on rails arranged along the upper side of the mould bed.

7. A method according to claim 6, wherein the reinforcement ropes are placed in the mould by a carriage movable on the rails.

* * * * *